US011628911B1

(12) United States Patent
Steele

(10) Patent No.: US 11,628,911 B1
(45) Date of Patent: Apr. 18, 2023

(54) BOAT HOOK WITH ATTACHED LIGHT

(71) Applicant: Nathan Steele, Norton, MA (US)

(72) Inventor: Nathan Steele, Norton, MA (US)

( * ) Notice: Subject to any disclaimer, the term of this patent is extended or adjusted under 35 U.S.C. 154(b) by 0 days.

(21) Appl. No.: 17/583,342

(22) Filed: Jan. 25, 2022

(51) Int. Cl.

| | |
|---|---|
| ***B63B 21/54*** | (2006.01) |
| ***B63B 45/02*** | (2006.01) |
| ***F21V 21/14*** | (2006.01) |
| ***F21S 9/02*** | (2006.01) |
| ***F21V 5/04*** | (2006.01) |
| ***F21V 23/04*** | (2006.01) |
| *F21Y 115/10* | (2016.01) |

(52) U.S. Cl.
CPC ..... *B63B 21/54* (2013.01); *B63B 45/02* (2013.01); *F21S 9/02* (2013.01); *F21V 5/04* (2013.01); *F21V 21/14* (2013.01); *F21V 23/04* (2013.01); *F21Y 2115/10* (2016.08)

(58) Field of Classification Search
CPC . B63B 21/54; B63B 45/02; F21S 9/02; F21V 5/04; F21V 21/14; F21V 23/04; A45B 3/02
See application file for complete search history.

(56) References Cited

U.S. PATENT DOCUMENTS

| | | | | |
|---|---|---|---|---|
| 2,889,797 | A | 6/1959 | Fox | |
| 3,165,067 | A | 1/1965 | Greenwald | |
| 4,793,646 | A * | 12/1988 | Michaud, Jr. | B63B 21/54 114/221 R |
| 4,986,207 | A | 1/1991 | Reed | |
| 5,003,437 | A * | 3/1991 | Barrett | F21L 2/00 114/221 R |
| 5,003,907 | A | 4/1991 | Roach | |
| 5,381,319 | A * | 1/1995 | Shiao | B25B 11/002 362/120 |
| 5,967,638 | A * | 10/1999 | Gorman, Jr. | F21L 2/00 362/582 |
| 6,176,592 | B1 * | 1/2001 | Kovacik | F21L 14/02 362/199 |
| 6,312,138 | B1 * | 11/2001 | Coleman, Jr. | B25B 11/002 362/120 |
| 6,865,998 | B2 | 3/2005 | Darling | |
| 7,299,765 | B1 * | 11/2007 | Phelps | G09F 17/00 114/221 R |
| 7,300,172 | B1 * | 11/2007 | Lefler | F21V 33/0044 362/396 |
| 9,314,920 | B1 * | 4/2016 | Jutras, Jr. | F21V 33/0084 |
| 2011/0012382 | A1 * | 1/2011 | Wang | B25B 23/18 294/190 |

FOREIGN PATENT DOCUMENTS

| | | |
|---|---|---|
| WO | 2004033286 | 4/2004 |

* cited by examiner

*Primary Examiner* — Oluseye Iwarere
*Assistant Examiner* — Michael Chiang

(57) ABSTRACT

The boat hook with attached light comprises a telescopic pole and an illuminated tip section. The illuminated tip section may couple to a distal end of the telescopic pole to form a boat hook. The boat hook may be operable as a tool for a boat. The boat hook may be operable as a docking and undocking aid and/or may be operable to pull items from the water using a hook on the illuminated tip section. The length of the telescopic pole may be adjustable. The illuminated tip section may provide illumination for use in dim lighting.

13 Claims, 3 Drawing Sheets

BOAT HOOK WITH ATTACHED LIGHT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of marine accessories, more specifically, a boat hook with attached light.

SUMMARY OF INVENTION

The boat hook with attached light comprises a telescopic pole and an illuminated tip section. The illuminated tip section may couple to a distal end of the telescopic pole to form a boat hook. The boat hook may be operable as a tool for a boat. The boat hook may be operable as a docking and undocking aid and/or may be operable to pull items from the water using a hook on the illuminated tip section. The length of the telescopic pole may be adjustable. The illuminated tip section may provide illumination for use in dim lighting.

An object of the invention is to provide a boat hook for use in marine applications.

Another object of the invention is to provide a telescopic pole such that the length of the boat hook may be adjusted.

A further object of the invention is to provide an illuminated tip section that provides illumination for use of the boat hook in dim lighting.

Yet another object of the invention is to provide a hook on the side of the illuminated tip section.

These together with additional objects, features and advantages of the boat hook with attached light will be readily apparent to those of ordinary skill in the art upon reading the following detailed description of the presently preferred, but nonetheless illustrative, embodiments when taken in conjunction with the accompanying drawings.

In this respect, before explaining the current embodiments of the boat hook with attached light in detail, it is to be understood that the boat hook with attached light is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the boat hook with attached light.

It is therefore important that the claims be regarded as including such equivalent construction insofar as they do not depart from the spirit and scope of the boat hook with attached light. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
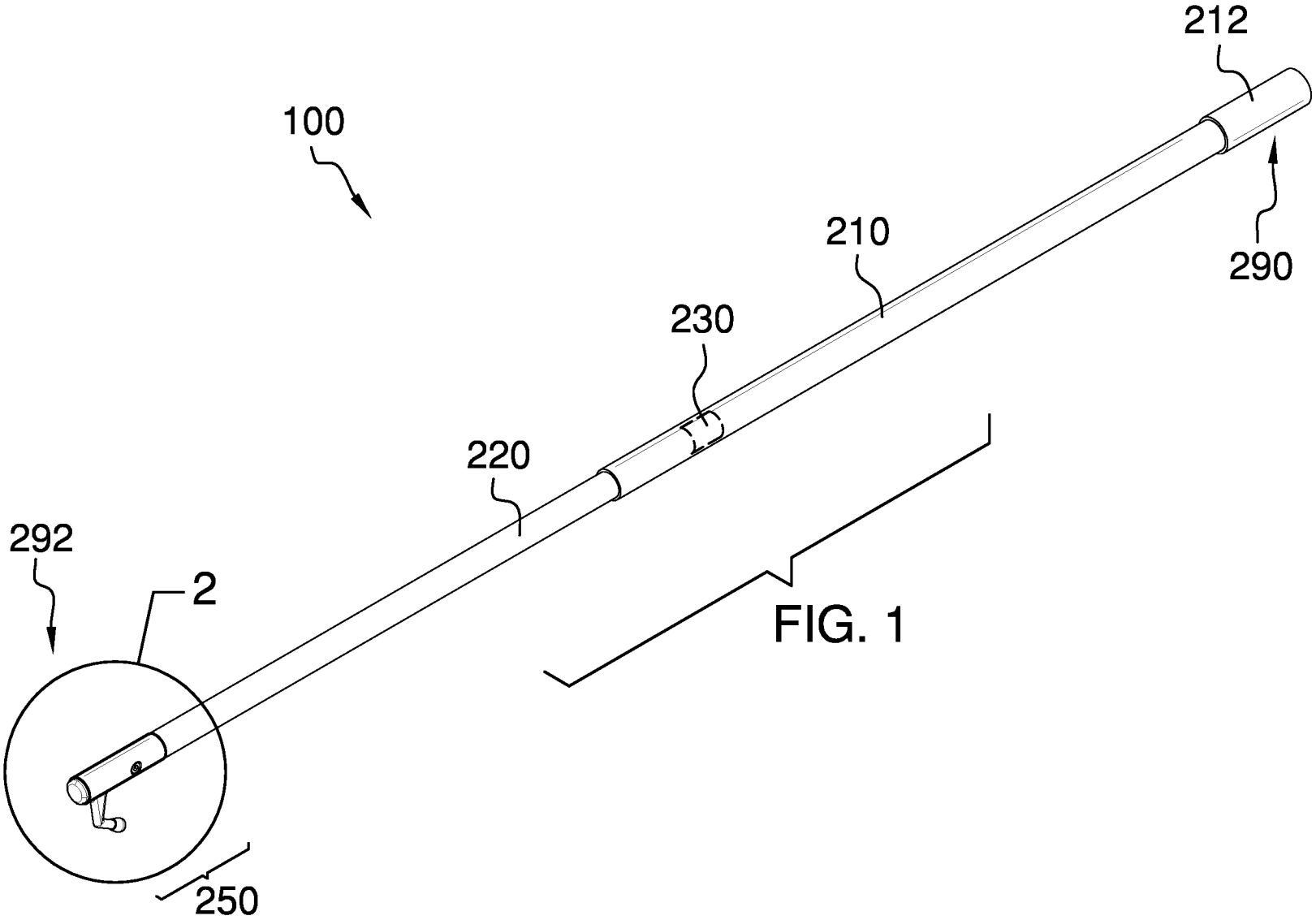
FIG. 1 is an isometric view of an embodiment of the disclosure.
Figure 2:
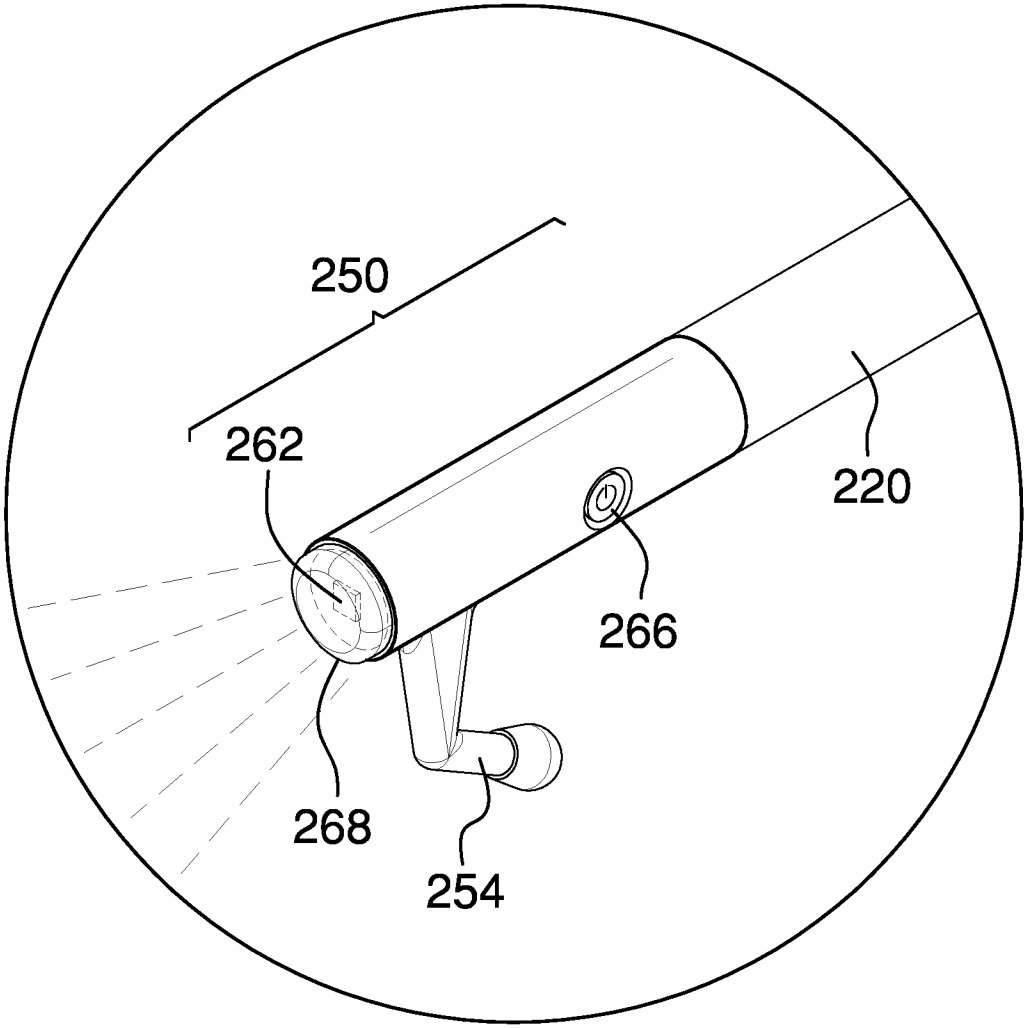
FIG. 2 is an isometric detail view of an embodiment of the disclosure illustrating the illuminated tip section.
Figure 3:
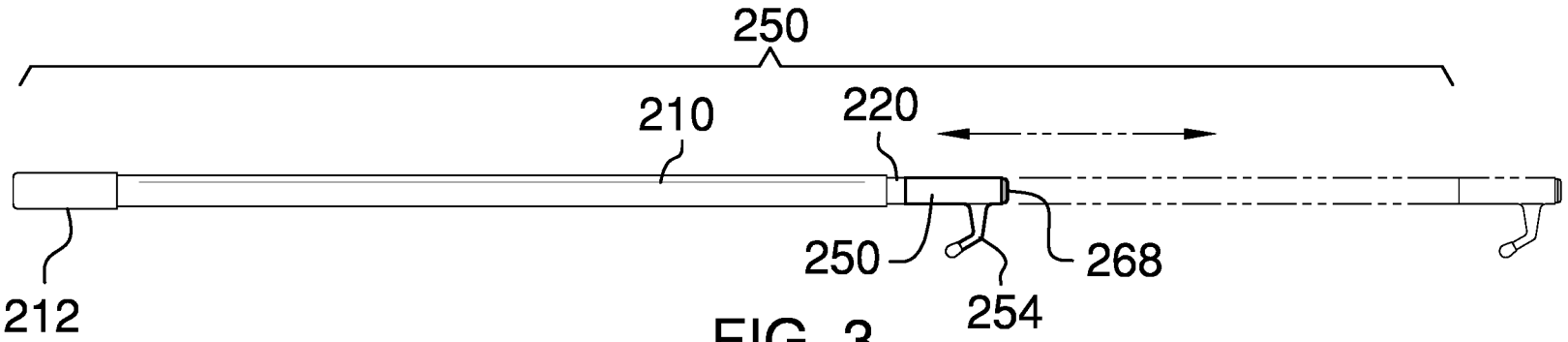
FIG. 3 is a side view of an embodiment of the disclosure.
Figure 4:
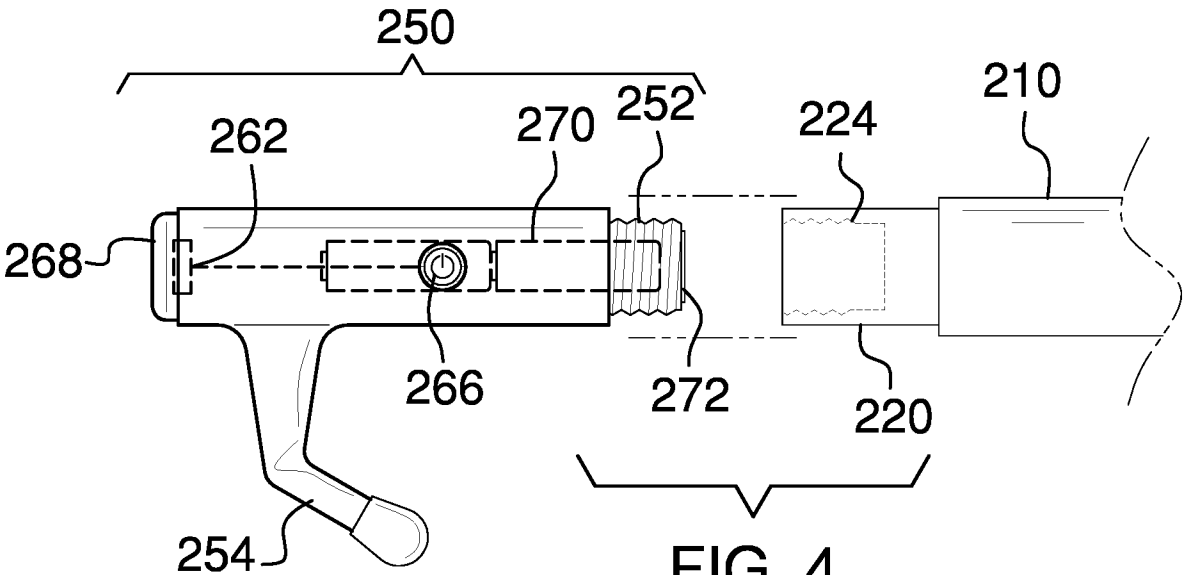
FIG. 4 is a side detail view of an embodiment of the disclosure illustrating the illuminated tip section.

Detailed reference will now be made to a first potential embodiment of the disclosure, which is illustrated in FIGS. 1 through 4.

The boat hook with attached light 100 (hereinafter invention) comprises a telescopic pole 200 and an illuminated tip section 250. The illuminated tip section 250 may couple to a distal end 292 of the telescopic pole 200 to form a boat hook. The boat hook may be operable as a tool for a boat. The boat hook may be operable as a docking and undocking aid and/or may be operable to pull items from water using a hook 254 on the illuminated tip section 250. The length of the telescopic pole 200 may be adjustable. The illuminated tip section 250 may provide illumination for use in dim lighting.

The telescopic pole 200 may comprise an outer pole section 210, an inner pole section 220, and a length lock 230. The inner pole section 220 may slide within the outer pole section 210 to vary the overall length of the telescopic pole 200 when the length lock 230 is disengaged. The inner pole section 220 may be held in a fixed position relative to the outer pole section 210 when the length lock 230 is engaged.

The outer pole section 210 and the inner pole section 220 may be a hollow cylindrical tubes. The inner pole section 220 may comprise a smaller diameter than the outer pole section 210 such that the inner pole section 220 may fit within the distal end 292 of the outer pole section 210. The inside diameter of the outer pole section 210 may be larger than the outside diameter of the inner pole section 220.

A proximal end 290 of the outer pole section 210 may comprise a cap 212. The cap 212 may be adapted to be gripped by a user while using the boat hook. The distal end 292 of the inner pole section 220 may comprise a female threaded fitting 224. The illuminated tip section 250 may couple to the telescopic pole 200 via the female threaded fitting 224.

The length lock 230 may be adapted to be engaged when the user moves the length lock 230 into a locked state. The length lock 230 may prevent the inner pole section 220 from sliding within the outer pole section 210 when the length lock 230 is in the locked state. The length lock 230 may be adapted to be disengaged when the user moves the length lock 230 into an unlocked state. The length lock 230 may permit the inner pole section 220 to slide within the outer pole section 210 when the length lock 230 is in the unlocked state.

In some embodiments, the length lock 230 may be an internal cam that increases and decreases friction between the inner pole section 220 and the outer pole section 210 when the inner pole section 220 is rotated relative to the outer pole section 210. The internal cam may increase friction between the inner pole section 220 and the outer pole section 210 when the inner pole section 220 is rotated in a first rotational direction. Friction between the inner pole section 220 and the outer pole section 210 may be increased to the point where the inner pole section 220 may be prevented from sliding within the outer pole section 210. The internal cam may decrease friction between the inner pole section 220 and the outer pole section 210 when the inner pole section 220 is rotated in a second rotational direction. Friction between the inner pole section 220 and the outer pole section 210 may be reduced to the point where the inner pole section 220 may be free to slide within the outer pole section 210.

In some embodiments, the length lock 230 may be a push button lock that may use a spring-loaded button on the inner pole section 220 to engage one of a plurality of lock apertures on the outer pole section 210. The inner pole section 220 may be prevented from sliding within the outer pole section 210 when the spring-loaded button aligns with one of the plurality of lock apertures. The inner pole section 220 may be free to slide within the outer pole section 210 when the spring-loaded button is depressed and disengaged from the plurality of lock apertures.

In some embodiments, the length lock 230 may be a twist collar that may be threadedly coupled to the distal end 292 of the outer pole section 210. The twist collar may increase friction between the inner pole section 220 and the outer pole section 210 when the twist collar is rotated in the first rotational direction such that the twist collar is pulled towards the center of the outer pole section 210. The twist collar may decrease friction between the inner pole section 220 and the outer pole section 210 when the twist collar is rotated in the second rotational direction such that the twist collar is pushed away from the center of the outer pole section 210.

In a preferred embodiment, the inner pole section 220 and the outer pole section 210 may be made of aluminum, the inner pole section 220 may have a length of 3.0+/−1.0 feet, and the outer pole section 210 may have a length of 4.0+/−1.0 feet.

The illuminated tip section 250 may comprise the hook 254 and an illumination subsystem. The illuminated tip section 250 may removably couple to the distal end 292 of the telescopic pole 200.

The hook 254 may be located on the side of the illuminated tip section 250. The hook 254 may extend away from the illuminated tip section 250 and may point towards the proximal end 290 of the invention 100. The hook 254 may be operable to pull the items that are in contact with the hook 254 while the items float in the water.

The illumination subsystem may comprise a source of illumination 262, an ON/OFF control 266, a lens 268, and one or more batteries 270. The illumination subsystem may be operable to provide illumination when the illumination subsystem is energized. As non-limiting examples, the illumination subsystem may illuminate a dock or the items floating in the water.

The source of illumination 262 may be located within the illuminated tip section 250 and optically accessible via the distal end 292 of the illuminated tip section 250. The source of illumination 262 may be covered by the lens 268 such that the source of illumination 262 may shine through the lens 268. In some embodiments, the source of illumination 262 may be one or more light emitting diodes (LEDs).

The lens 268 may be made of clear plastic such that the illumination subsystem may shine through the lens 268. The lens 268 may be coupled to the illuminated tip section 250 and may cover the distal end 292 of the illuminated tip section 250. The lens 268 may provide a blunt end to the illuminated tip section 250 such that the boat hook may be operable to push away from the dock.

The ON/OFF control 266 may be operable to energize and to de-energize the source of illumination 262. The ON/OFF control 266 may energize the source of illumination 262 by electrically coupling the one or more batteries 270 to the source of illumination 262 when the ON/OFF control 266 is in an ON state. The ON/OFF control 266 may de-energize the source of illumination 262 by electrically decoupling the one or more batteries 270 from the source of illumination 262 when the ON/OFF control 266 is in an OFF state. In some embodiments, the ON/OFF control 266 may be recessed within the illuminated tip section 250 to prevent accidental depressions of the ON/OFF control 266.

The one or more batteries 270 may comprise one or more energy-storage devices. The one or more batteries 270 may be a source of electrical energy to operate the illumination subsystem. The one or more batteries 270 may be rechargeable and/or replaceable.

The illuminated tip section 250 may comprise a male threaded fitting 252 located on the proximal end 290 of the illuminated tip section 250. The illuminated tip section 250 may threadedly couple to the distal end 292 of the inner pole section 220 by threadedly coupling the male threaded fitting 252 on the illuminated tip section 250 to the female threaded fitting 224 on the inner pole section 220. In some embodiments, the one or more batteries 270 may be accessible via a battery cover 272 located on the illuminated tip section 250. The battery cover 272 may be watertight to prevent the water from entering the interior of the illuminated tip section 250. As a non-limiting example, the battery cover 272 may be located at the proximal end 290 of the illuminated tip section 250 adjacent to the male threaded fitting 252 such that the one or more batteries 270 are replaced through the center of the male threaded fitting 252 when the illuminated tip section 250 is removed from the telescopic pole 200.

In use, one or more batteries 270 may be installed within the illuminated tip section 250 and the illuminated tip section 250 may be threadedly coupled to the telescopic pole 200. The invention 100 may be used from a boat to push the boat away from the dock or to pull floating objects towards the boat using the hook 254. The invention 100 may also be used from the dock or from shore to pull the floating objects. The length of the telescopic pole 200 may be increased to extend the reach by unlocking the length lock 230, extending the inner pole section 220, and locking the length lock 230. The length of the telescopic pole 200 may be decreased for storage by unlocking the length lock 230, retracting the inner pole section 220, and locking the length lock 230. In dim light, the source of illumination 262 may be energized using the ON/OFF control 266 and the source of illumination 262 may illuminate the dock or the floating objects.

Definitions

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, "boat hook" may refer to an item of boating equipment that may be used during docking, during undocking, and for pulling items from the water. A boat hook may have a blunt end for pushing during undocking and a hook for pulling during docking. The hook may also be operable to pull items from the water.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw. In some embodiments, a control may alter an electrical property of a circuit such as resistance, inductance, or capacitance.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "energize" and/or "energization" may refer to the application of an electrical potential to a system or subsystem.

As used herein, "inside diameter" or "inner diameter" may refer to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the word "interior" may be used as a relational term that implies that an object is located or contained within the boundary of a structure or a space.

As used in this disclosure, a "lens" may be a transparent substance through which light can pass. A lens may or may not be formed with curved surfaces that are used to concentrate or disperse the light that travels through the lens.

As used herein, "outside diameter" or "outer diameter" may refer to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, "telescopic", "telescoping", and "telescopically" may refer to an object made of sections that fit or slide into each other such that the object can be made longer or shorter by adjusting the relative positions of the sections.

As used in this disclosure, a "tool" may be a device, an apparatus, or an instrument that is used to carry out an activity, operation, or procedure.

As used herein, the word "watertight" may refer to a barrier that is impermeable to water.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A boat hook with attached light comprising:

a telescopic pole and an illuminated tip section;

wherein the illuminated tip section couples to a distal end of the telescopic pole to form a boat hook;

wherein the boat hook is operable as a tool for a boat;

wherein the boat hook is operable as a docking and undocking aid and/or is operable to pull items from the water using a hook on the illuminated tip section;

wherein the length of the telescopic pole is adjustable;

wherein the illuminated tip section provides illumination for use in dim lighting;

wherein the telescopic pole comprises an outer pole section, an inner pole section, and a length lock;

wherein the inner pole section slides within the outer pole section to vary the overall length of the telescopic pole when the length lock is disengaged;

wherein the inner pole section is held in a fixed position relative to the outer pole section when the length lock is engaged; the distal end of the inner pole section comprises a female threaded fitting; wherein the illuminated tip section couples to the telescopic pole via the female threaded fitting wherein a proximal end of the outer pole section comprises a cap;

wherein the cap is adapted to be gripped by a user while using the boat hook;

wherein the illumination subsystem comprises a source of illumination, an ON/OFF control, a lens, and one or more batteries;

wherein the illumination subsystem is operable to provide illumination when the illumination subsystem is energized;

wherein the one or more batteries are accessible via a battery cover located on the illuminated tip section;

wherein the battery cover is watertight to prevent the water from entering the interior of the illuminated tip section; the illuminated tip section comprises a male threaded fitting located on the proximal end of the illuminated tip section; wherein the illuminated tip section threadedly couples to the distal end of the inner pole section by threadedly coupling the male threaded fitting on the illuminated tip section to the female threaded fitting on the inner pole section wherein the battery cover is located at a proximal end of the illuminated tip section adjacent to the male threaded fitting such that the one or more batteries are replaced through the center of the male threaded fitting when the illuminated tip section is removed from the telescopic pole.

2. The boat hook with attached light according to claim 1 wherein the outer pole section and the inner pole section are hollow cylindrical tubes;

wherein the inner pole section comprises a smaller diameter than the outer pole section such that the inner pole section fits within the distal end of the outer pole section;

wherein the inside diameter of the outer pole section is larger than the outside diameter of the inner pole section.

3. The boat hook with attached light according to claim 2 wherein the length lock is adapted to be engaged when the user moves the length lock into a locked state;

wherein the length lock prevents the inner pole section from sliding within the outer pole section when the length lock is in the locked state.

4. The boat hook with attached light according to claim 3 wherein the length lock is adapted to be disengaged when the user moves the length lock into an unlocked state;

wherein the length lock permits the inner pole section to slide within the outer pole section when the length lock is in the unlocked state.

5. The boat hook with attached light according to claim 4 wherein the inner pole section and the outer pole section are made of aluminum, the inner pole section has a length of 3.0+/−1.0 feet, and the outer pole section has a length of 4.0+/−1.0 feet.

6. The boat hook with attached light according to claim 4 wherein the illuminated tip section comprises the hook and an illumination subsystem;

wherein the illuminated tip section removably couples to the distal end of the telescopic pole.

7. The boat hook with attached light according to claim 6 wherein the hook is located on the side of the illuminated tip section;

wherein the hook extends away from the illuminated tip section and points towards the proximal end of the boat hook with attached light;

wherein the hook is operable to pull the items that are in contact with the hook while the items float in the water.

8. The boat hook with attached light according to claim 7 wherein the source of illumination is located within the illuminated tip section and optically accessible via the distal end of the illuminated tip section;

wherein the source of illumination is covered by the lens such that the source of illumination shines through the lens.

9. The boat hook with attached light according to claim 8 wherein the source of illumination is one or more light emitting diodes.

10. The boat hook with attached light according to claim 8 wherein the lens is made of clear plastic such that the illumination subsystem shines through the lens;

wherein the lens is coupled to the illuminated tip section and covers the distal end of the illuminated tip section;

wherein the lens provides a blunt end to the illuminated tip section such that the boat hook is operable to push away from a dock.

11. The boat hook with attached light according to claim 10 wherein the ON/OFF control is operable to energize and to de-energize the source of illumination;

wherein the ON/OFF control energizes the source of illumination by electrically coupling the one or more batteries to the source of illumination when the ON/OFF control is in an ON state;

wherein the ON/OFF control de-energizes the source of illumination by electrically decoupling the one or more batteries from the source of illumination when the ON/OFF control is in an OFF state.

12. The boat hook with attached light according to claim 11 wherein the ON/OFF control is recessed within the illuminated tip section to prevent accidental depressions of the ON/OFF control.

13. The boat hook with attached light according to claim 11 wherein the one or more batteries comprise one or more energy-storage devices;

wherein the one or more batteries are a source of electrical energy to operate the illumination subsystem;

wherein the one or more batteries are rechargeable and/or replaceable.

* * * * *